US008304703B2

(12) United States Patent
Hong et al.

(10) Patent No.: US 8,304,703 B2
(45) Date of Patent: Nov. 6, 2012

(54) APPARATUS FOR DEPLOYING WING AND APPARATUS FOR LAUNCHING FLIGHT HAVING THE SAME

(75) Inventors: Heon Suk Hong, Daejeon (KR); Sang Hun Shin, Daejeon (KR); Woo Yong Lee, Daejeon (KR)

(73) Assignee: Agency for Defense Development, Daejeon (KR)

( * ) Notice: Subject to any disclaimer, the term of this patent is extended or adjusted under 35 U.S.C. 154(b) by 286 days.

(21) Appl. No.: 12/757,191

(22) Filed: Apr. 9, 2010

(65) Prior Publication Data

US 2010/0314490 A1 Dec. 16, 2010

(30) Foreign Application Priority Data

Jun. 11, 2009 (KR) ..... 10-2009-0052052

(51) Int. Cl.
*F42B 15/01* (2006.01)

(52) U.S. Cl. ..... 244/3.27; 244/49

(58) Field of Classification Search ..... 244/3.27, 244/3.28, 3.29, 3.23, 46, 49
See application file for complete search history.

(56) References Cited

U.S. PATENT DOCUMENTS

| | | | | |
|---|---|---|---|---|
| 5,615,846 | A * | 4/1997 | Shmoldas et al. | 244/3.28 |
| 5,671,899 | A * | 9/1997 | Nicholas et al. | 244/49 |
| 6,609,597 | B1 * | 8/2003 | Heideman | 188/276 |
| 6,880,780 | B1 * | 4/2005 | Perry et al. | 244/3.27 |
| 7,147,181 | B2 * | 12/2006 | Selin et al. | 244/3.27 |
| 7,314,124 | B2 * | 1/2008 | Martyn et al. | 188/318 |

* cited by examiner

*Primary Examiner* — Michael Carone
*Assistant Examiner* — Jamie S Stehle
(74) *Attorney, Agent, or Firm* — Scully, Scott, Murphy & Presser, P.C.

(57) ABSTRACT

Disclosed are a wing deployment apparatus and an apparatus for launching a flying object having the same, the wing deployment apparatus including wings configured to be in a folded state and a deployed state, a driving unit connected to the wings, and configured to drive the wings to be switched from the folded state to the deployed state or vice versa, and a damper cooperative with the operation of the driving unit, and configured to damp a driving force of the driving unit from the start of the wings being moved to the completion of the movement of the wings.

10 Claims, 5 Drawing Sheets

APPARATUS FOR DEPLOYING WING AND APPARATUS FOR LAUNCHING FLIGHT HAVING THE SAME

CROSS-REFERENCE TO RELATED APPLICATION

Pursuant to 35 U.S.C. §119(a), this application claims the benefit of earlier filing date and right of priority to Korean Application No. 10-2009-0052052, filed on Jun. 11, 2009, the contents of which is incorporated by reference herein in its entirety.

BACKGROUND OF THE INVENTION

1. Field of the Invention

The present invention relates to an apparatus for folding or deploying wings and an apparatus for launching a flight having the same.

2. Background of the Invention

In general, guided weapons such as guided missiles are initially accommodated in a launch tube and then launched by manipulation to come out of the launch tube. In the accommodated state, wings may be folded within the launch tube in order to minimize an inner diameter of the launch tube.

Initial stability and flying performance maintenance of such guided weapons may depend on fast unfolding of folded wings, provision against deployment impact responsive to the fast folding and maintenance of a preset deployment time for external conditions upon the deployment.

SUMMARY OF THE INVENTION

Therefore, an object of the present invention is to provide a wing deployment apparatus capable of damping a movement of wings for folding and unfolding, which is driven in a different manner from the related art, and an apparatus for launching a flying object (flight, flying vehicle) having the same.

Another object of the present invention is to alleviate an impact, which is to be given when the wings stop moving during the movement, by allowing the continuous damping from the start of the movement of the wings to the completion thereof.

To achieve these and other advantages and in accordance with the purpose of the present invention, as embodied and broadly described herein, there is provided a wing deployment apparatus including wings, a driving unit and a damper. The wings may be configured to be in a folded state and a deployed state with respect to one object. The driving unit may be connected to the wings so as to drive the wings to be switched from the folded state to the deployed state or vice versa. The damper may be cooperative with the operation of the driving unit, and configured to damp a driving force of the driving unit from the start of the wings being moved to the completion of the movement of the wings.

In one aspect of the present invention, the driving unit may include a linear motion unit driven to execute a linear motion, and rotational motion units each having one end connected to the linear motion unit and another end connected to the corresponding wing, thus to rotate in response to the linear motion of the linear motion unit.

In another aspect of the present invention, the linear motion unit may be configured in the form of a piston-cylinder assembly, and the rotational motion units may include rotation links each having first and second portions rotatably coupled to the cylinder and the wing, respectively. The piston may further include extending portions lengthening in a direction intersecting with a direction that the piston moves within an inner space of the cylinder, and the first portions of the rotation links may be rotatably coupled to the extending portions.

In another aspect of the present invention, the damper may include a piston coupled to the linear motion unit so as to linearly move, and having an orifice, and a cylinder having an inner space for inserting the piston therein and storing fluid within the inner space, the fluid applying resistance for the damping to the piston while flowing from a first region to a second region via the orifice in response to the movement of the piston. The apparatus may further include a pressing unit installed at an inner space of the cylinder, and configured to press the flowed fluid toward the piston. The orifices may be provided in plurality, and a control member may be provided to control opening and closing of at least one of the orifices.

In accordance with another embodiment of the present invention, an apparatus for launching a flying object may include a launch tube having an accommodation space therein, a fuselage loaded in the accommodation space and propelled to come out of the accommodation space upon launching, wings disposed to be folded and deployed with respect to the fuselage, a driving unit connected to the fuselage and the wings, respectively, and configured to driven the wings to be switched from the folded state to the deployed state or vice versa, and a damper cooperative with the operation of the driving unit, and configured to damp a driving force of the driving unit from the start of the wings being moved to the completion of the movement of the wings.

In one aspect of the present invention, the driving unit may include a linear motion unit driven to execute a linear motion, and rotational motion units each having one end connected to the linear motion unit and another end connected to the corresponding wing, thus to rotate in response to the linear motion of the linear motion unit.

In another aspect of the present invention, the damper may include a piston coupled to the linear motion unit so as to linearly move, the piston having an orifice, and a cylinder having an inner space for inserting the piston therein and storing fluid within the inner space, the fluid applying resistance for the damping to the piston while flowing from a first region to a second region via the orifice in response to the movement of the piston.

The wing deployment apparatus and the flying object launching apparatus having the same according to the present invention having such configurations, the wings, which are movable between the folded state and the deployed state with respect to the fuselage, can be affected by resistance applied from the damper from when the wings start being moved by the driving unit, resulting in damping of an impact caused by stopping of the wings during their movement.

Such damping can be kept executed during the movement of the wings, thereby enabling rapid deployment of the wings by virtue of increase in the speed of the movement.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
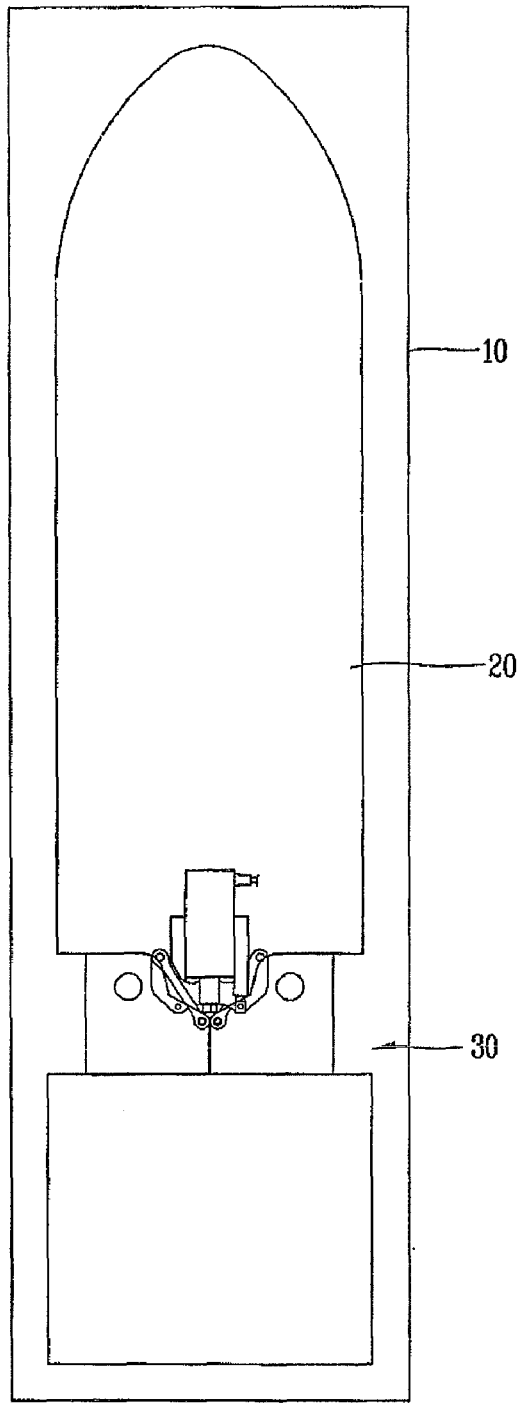
FIG. 1 is an overview illustrating an apparatus for launching a flying object in accordance with one embodiment of the present invention.

Description will now be given in detail of a wing deployment apparatus and an apparatus for launching a flying object having the same the present invention, with reference to the accompanying drawings. The specification may specify the like/similar components with the like/similar reference numerals even in different embodiments, so the description thereof will be understood by the first description.

FIG. 1 is an overview illustrating an apparatus for launching a flying object in accordance with one embodiment of the present invention.

As shown in FIG. 1, an apparatus for launching a flying object may include a launch tube 10 and a flying object (flight, flying vehicle).

The launch tube 10 may have a cylindrical body with an inner space, and be mounted at flights, battleships, battle vehicles and the like. Flying objects, such as guided missiles, may be loaded within the inner space of the launch tube 10.

The flying object may be configured by including a fuselage and a wing deployment apparatus 30. The fuselage 20 may typically have a circular section and extend in a lengthwise direction. Electronic components for controlling flying of the flying object, propellants for generating a propulsive force, explosives and the like may be mounted within the fuselage 20. The fuselage 20 may be propelled by the propellants so as to be separated from (come out of) the inner space upon launching.

The wing deployment apparatus 30 may be accommodated within the inner space in a folded state; however, when it comes out of the inner space, the wing deployment apparatus 30 may be unfolded into a deployed state. The wing deployment apparatus 30 will be described in detail with reference to FIGS. 2 to 5.

Figure 2:
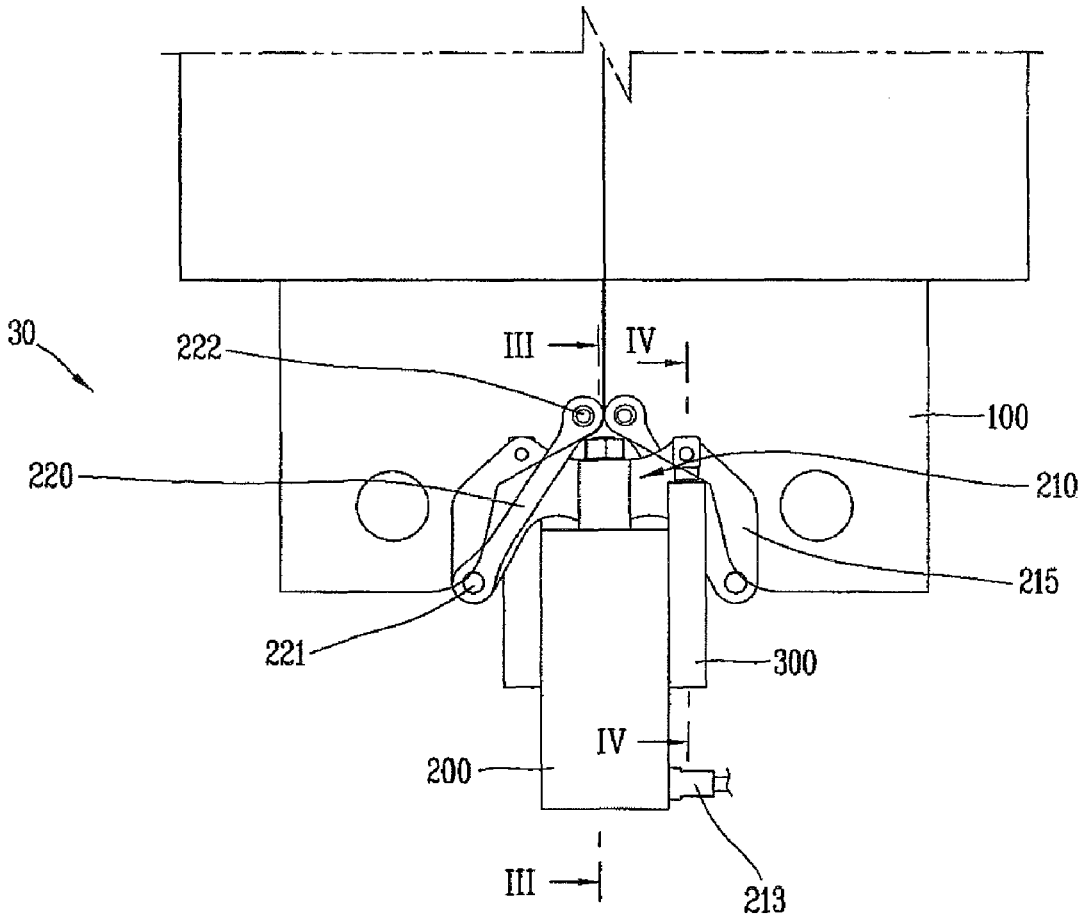
FIG. 2 is a front view illustrating a folded state of the wing deployment apparatus of FIG. 1.
Figure 3:
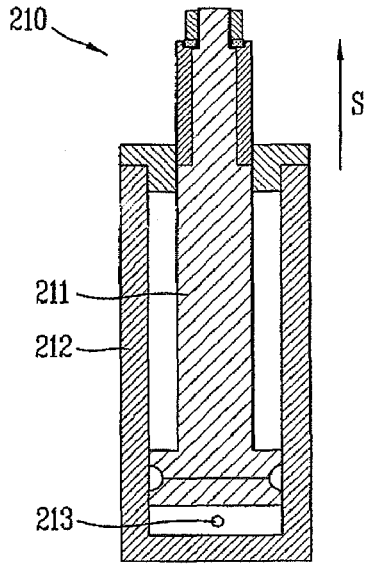
FIG. 3 is a sectional view taken along the line III-III of FIG. 2.
Figure 4:
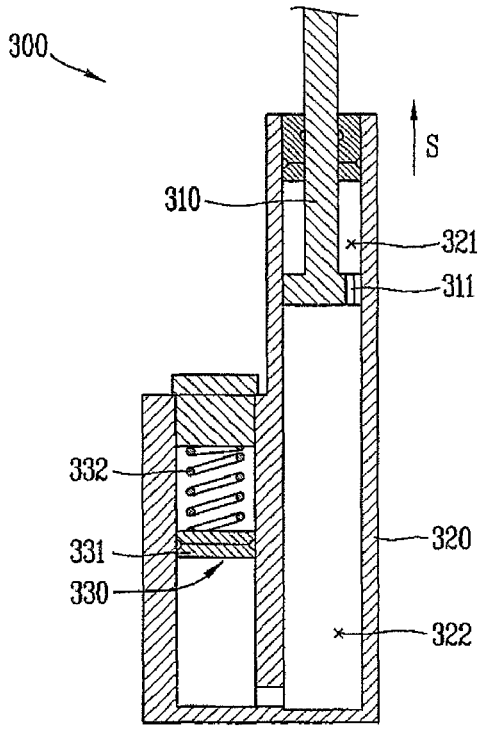
FIG. 4 is a sectional view taken along the line IV-IV of FIG. 2.

FIG. 2 is a front view illustrating a folded state of the wing deployment apparatus of FIG. 1, FIG. 3 is a sectional view taken along the line III-III of FIG. 2, and FIG. 4 is a sectional view taken along the line IV-IV of FIG. 2.

Referring to FIG. 2, the wing deployment apparatus 30 may include wings 100, a driving unit 200 and a damper 300.

The wings 100 may be provided in pair and disposed in an overlaid state.

The driving unit 200 may be connected to the fuselage 20 (see FIG. 1) and the wings 100, so as to drive the wings 100 to be switched from a folded state to a deployed state (see FIG. 6) or vice versa.

The driving unit 200, in detail, may include a linear motion unit 210 driven to execute a linear motion and rotational motion units 220 driven to execute a rotational motion in cooperation with the linear motion unit 210. One end of each rotational motion unit 220 may be connected to the linear motion unit 210 and another end thereof may be connected to the corresponding wing 100. The rotational motion units 220 are rotated in cooperation with the linear motion of the linear motion unit 210, thereby driving the wings 100.

Referring to FIG. 3, the linear motion unit 210 may include a piston 211, a cylinder 212 and an inlet 213. The piston 211 may be linearly movable within an inner space of the cylinder 212. For moving the piston 211, fluid such as air or oil may be supplied via the inlet 213 communicating with the inner space of the cylinder 212. The piston 211 is linearly moved in one direction S responsive to the supply of the fluid, and moved in an opposite direction to the direction S due to recollection of the fluid.

Referring back to FIG. 2, each of the rotational motion units 220 may be configured as a link or bar, which is structured such that a first portion 221 is rotatably connected to the piston 211 and a second portion 222 is rotatably connected to the corresponding wing 100. In this embodiment, the first and second portions 221 and 222 may correspond to both end portions of each rotation link. If the piston 211 is further provided with extending portion 215, each of which extends in an intersecting direction with the movement direction S of the piston 211, first portions 221 may be connected to the extending portions 215. If the rotational motion units 220 are provided as a plurality of rotation links corresponding to the pair of wings 100, the extending portions 215 may provide spaces for installation of the plurality of rotation links.

The damper 300 may have one end connected to the driving unit 200, in detail, to the linear motion unit 210 so as to cooperate with the movement thereof. Accordingly, as soon as the linear motion unit 210 starts moving, the damper 300 may also start damping the movement of the linear motion unit 210. The operation of the damper 300 is continued as long as the linear motion unit 210 continuously moves.

Referring to FIG. 4, the damper 300 may include a piston 310 and a cylinder 320. One end portion of the piston 310 may be inserted in an inner space of the cylinder 320 so as to linearly move within the inner space. Another end portion of the piston 310 may be connected to the extending portions 215 (see FIG. 2) of the piston 211 in the driving unit 200.

An orifice 311 may be formed at a lower portion of the piston 310. Also, the inner space of the cylinder 320 may be divided into a first region 321 and a second region 322 by the lower portion of the piston 310. With the configuration, if the piston 310 moves in the direction S in cooperation with the piston 211 (see FIG. 2) moving in the direction S, fluid within the first region 321 flows into the second region 322 via the orifice 311 with applying resistance to the movement of the piston 310. The resistance may damp the driving force of the driving unit 200 having the piston 211.

A pressing unit 330 may further be provided at a portion of the cylinder 320. The pressing unit 330 may be located within the inner space in which the piston 310 moves, and configured to press fluid within the second region 322 toward the piston 310. This configuration is intended to reduce a vacuum portion, which may be formed near the piston 310 while fluid flows from the first region 321 to the second region 322. The pressing unit 330 may include a pressing plate 331 configured to come in contact with fluid, and an elastic member 332 for pressing the pressing plate 331.

Figure 5:
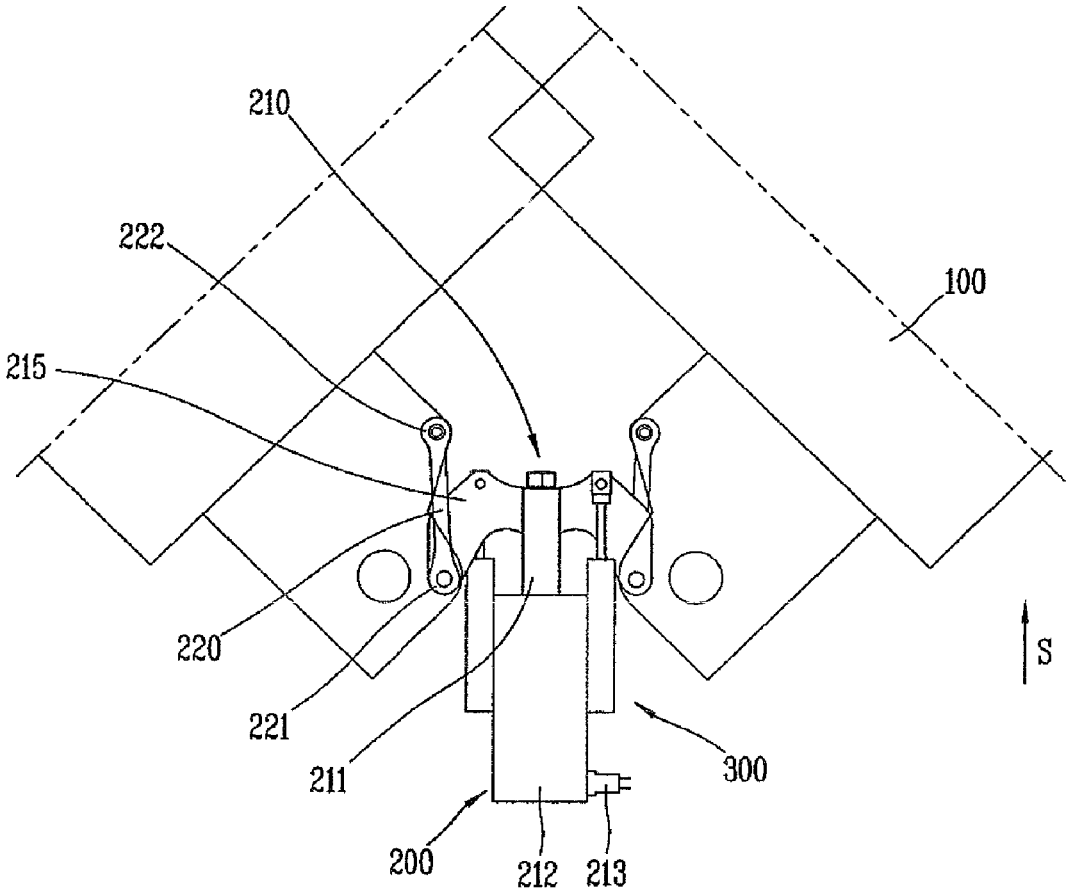
FIG. 5 is a front view illustrating a half deployed state of the wing deployment apparatus of FIG. 2.

FIG. 5 is a front view illustrating a half deployed state of the wing deployment apparatus 30 of FIG. 2.

As shown in FIG. 5, once fluid is supplied via the inlet 213 of the driving unit 200, the piston 211 flows in one direction S. In response to the movement, the extending portions 215 become located farther away from one end portion of the cylinder 212 and the rotational motion units 220 relatively rotate in a direction that the second portions 222 are getting away from each other. Consequently, the wings 100 are deployed to intersect with each other.

Figure 6:
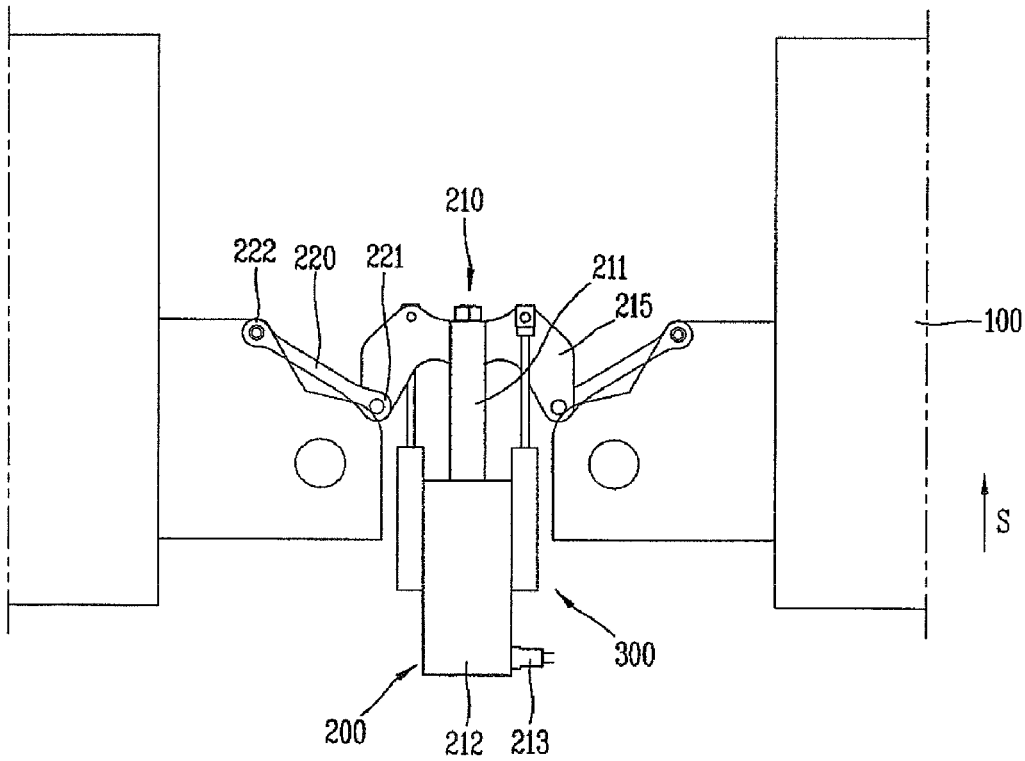
FIG. 6 is a front view illustrating a completely deployed state of the wing deployment apparatus of FIG. 5.

FIG. 6 is a front view illustrating a completely deployed state of the wing deployment apparatus 30 of FIG. 5.

As shown in FIG. 6, as the piston 211 further moves from the state of FIG. 5, the second portions 222 of the rotational motion units 220 further rotate based upon the first portions 221, respectively.

Accordingly, the wings 100 are switched to a deployed state in which the wings 100 unfolded to be approximately in parallel to each other. During the deployment process, the damper 300 is also driven in cooperation with the driving unit 200 such that the wings 100 are not instantaneously stopped but slowly stopped.

Figure 7:
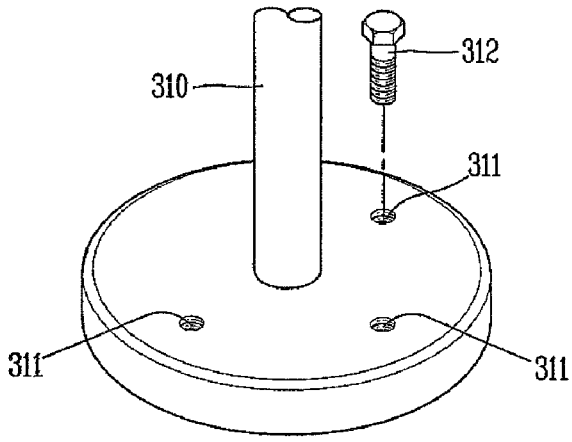
FIG. 7 is a perspective view illustrating a piston in accordance with one variation of FIG. 4.

FIG. 7 is a perspective view illustrating a piston 310 in accordance with one variation of FIG. 4.

Referring to FIG. 7, an orifice 311 formed at a lower portion of a piston 310 may be provided in plurality. At least one of the orifices 311 may be blocked by a control member 312 for controlling the opening and closing thereof. The control member 312 may be a member having another screw thread which is coupled to a screw thread formed at an inner circumference of the orifice 311.

The damping amount of the damper 300 can be controlled by the control of the opening and closing of the orifices 311. For instance, if many number of orifices 311 are open, the damping amount may be reduced. On the other hand, if less number of orifices 311 is open, the damping amount may be relatively increased. Accordingly, even if the same damper 300 is employed, the damping amount can be controlled in correspondence with characteristics of flying objects or the like employing the damper 300.

The constructions and operation methods of the foregoing embodiments and advantages of the wing deployment apparatus and the apparatus for launching a flying object having the same are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A wing deployment apparatus comprising:

a plurality of wings configured to be in a folded state and a deployed state;

a driving unit connected to the plurality of wings, and configured to drive the plurality of wings to be switched from the folded state to the deployed state or vice versa; and a damper cooperative with the operation of the driving unit, and configured to dampen a driving force of the driving unit from the start of the movement of the plurality of wings to the completion of the movement of the plurality of wings, and wherein the driving unit comprises a linear motion unit, the linear motion unit comprising an assembly comprising a first piston and a first cylinder, the linear motion unit further comprising a plurality of extending portions connected to the first piston, the first piston movable along a first direction, and wherein the damper comprises a second piston and a second cylinder, the second cylinder being adjacent to the first cylinder, an end of the second piston being connected to one of the plurality of extending portions to be interlocked with the first piston.

2. The apparatus of claim 1, wherein the driving unit further comprises:

a plurality of rotational motion units each having one end connected to the linear motion unit and another end connected to a corresponding wing, the rotational motion units executing a rotational motion in response to the linear motion of the linear motion unit.

3. The apparatus of claim 2, wherein the plurality of rotational motion units each comprise a rotation link having a first portion rotatably coupled to the first cylinder and a second portion rotatably coupled to the corresponding wing, respectively.

4. The apparatus of claim 3, wherein the plurality of extending portions extend substantially in a second direction intersecting with the first direction that the first piston moves within an inner space of the first cylinder, wherein the first portion of the rotation link is rotatably coupled to the plurality of extending portions.

5. The apparatus of claim 2, wherein the second piston moves linearly and has at least one orifice, and wherein the second cylinder has an inner space for inserting the second piston and storing fluid, the fluid applying resistance for damping the second piston while flowing from a first region to a second region via the orifice in response to the movement of the second piston.

6. The apparatus of claim 5, further comprising a pressing unit installed at the inner space of the second cylinder, and configured to press the flowed fluid toward the second piston.

7. The apparatus of claim 5, wherein the at least one orifice comprises a plurality of orifices, and wherein the apparatus further comprises a control member configured to control opening and closing of at least one of the plurality of orifices.

8. An apparatus for launching a flying object comprising:

a launch tube having an accommodation space therein;

a fuselage loaded in the accommodation space and propelled to come out of the accommodation space upon launching;

a plurality of wings disposed to be folded and deployed with respect to the fuselage;

a driving unit connected to the fuselage and the plurality of wings, respectively, and configured to drive the plurality of wings to be switched from the folded state to the deployed state or vice versa; and a damper cooperative with the operation of the driving unit, and configured to dampen a driving force of the driving unit from the start of the movement of the plurality of wings to the completion of the movement of the plurality of wings, and wherein the linear motion unit comprising an assembly comprising a first piston and a first cylinder, the linear motion unit further comprising a plurality of extending portions connected to the first piston, the first piston movable along a first direction, and wherein the damper comprises a second piston and a second cylinder, the second cylinder being adjacent to the first cylinder, an end of the second piston being connected to one of the plurality of extending portions to be interlocked with the first piston.

9. The apparatus of claim 8, wherein the driving unit further comprises:

a plurality of rotational motion units each having one end connected to the linear motion unit and another end connected to a corresponding wing, the plurality of rotational motion units executing a rotational motion in response to the linear motion of the linear motion unit.

10. The apparatus of claim 8, wherein the second piston moves linearly and has at least one orifice, and wherein the second cylinder has an inner space for inserting the second piston and storing fluid, the fluid applying resistance for damping the piston while flowing from a first region to a second region via the at least one orifice in response to the movement of the second piston.

* * * * *